US009666135B2

(12) United States Patent
Koo et al.

(10) Patent No.: US 9,666,135 B2
(45) Date of Patent: May 30, 2017

(54) DISPLAY DEVICE AND DRIVING METHOD THEREOF

(71) Applicant: Samsung Display Co., Ltd., Yongin (KR)

(72) Inventors: Bon-Sung Koo, Seongnam-si (KR); Jong Jae Lee, Hwaseong-si (KR); Eui-Dong Hwang, Bucheon-si (KR); Jun Dal Kim, Daegu (KR); Yang Uk Nam, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 308 days.

(21) Appl. No.: 14/329,635

(22) Filed: Jul. 11, 2014

(65) Prior Publication Data

US 2015/0115826 A1 Apr. 30, 2015

(30) Foreign Application Priority Data

Oct. 31, 2013 (KR) ..... 10-2013-0131409

(51) Int. Cl.
*G09G 5/10* (2006.01)
*G09G 3/3266* (2016.01)

(52) U.S. Cl.
CPC ..... *G09G 3/3266* (2013.01); *G09G 2320/041* (2013.01)

(58) Field of Classification Search
None
See application file for complete search history.

(56) References Cited

U.S. PATENT DOCUMENTS

| | | | | |
|---|---|---|---|---|
| 5,670,973 | A | 9/1997 | Bassetti, Jr. et al. | |
| 7,119,495 | B2 | 10/2006 | Jang | |
| 7,446,489 | B2 | 11/2008 | Jang | |
| 7,486,288 | B2 | 2/2009 | Kojima | |
| 7,786,966 | B2 | 8/2010 | Nakanishi et al. | |
| 8,138,818 | B2 | 3/2012 | Tsunoda et al. | |
| 2003/0151586 | A1* | 8/2003 | Mori | G09G 3/36 345/101 |
| 2009/0027327 | A1* | 1/2009 | Urisu | G09G 3/3406 345/101 |
| 2012/0169744 | A1 | 7/2012 | Seo et al. | |

FOREIGN PATENT DOCUMENTS

| | | |
|---|---|---|
| KR | 100518556 | 10/2005 |
| KR | 1020080002304 | 1/2008 |
| KR | 1020110096424 | 8/2011 |
| KR | 101148778 | 5/2012 |

* cited by examiner

*Primary Examiner* — Nicholas Lee
(74) *Attorney, Agent, or Firm* — H.C. Park & Associates, PLC

(57) ABSTRACT

Provided is a display device, including: a plurality of pixels; a scan driver connected to a plurality of scanning lines connected to the plurality of pixels; and a gate signal generator configured to determine a level of a gate-on voltage according to ambient temperature and to supply the gate-on voltage to the scan driver, wherein the gate signal generator is further configured to apply a hysteresis characteristic to a thermistor voltage to vary according to the ambient temperature.

20 Claims, 7 Drawing Sheets

DISPLAY DEVICE AND DRIVING METHOD THEREOF

CROSS-REFERENCE TO RELATED APPLICATION

This application claims priority from and the benefit of Korean Patent Application No. 10-2013-0131409, filed on Oct. 31, 2013, which is hereby incorporated by reference for all purposes as if fully set forth herein.

BACKGROUND

Field

Exemplary embodiments of the present invention relate to a display device and a driving method thereof. More particularly, exemplary embodiments of the present invention relate to a display device capable of compensating the level of a gate-on voltage for variations in ambient temperature, and a driving method thereof.

Discussion of the Background

A pixel-based display device usually includes a plurality of scanning lines and a plurality of data lines connected to a plurality of pixels. The plurality of pixels are formed at crossing points of the scanning lines and the data lines.

More specifically, a typical display device includes a scan driver to sequentially apply scanning signals of the gate-on voltage to the plurality of scanning lines and a data driver to apply data signals to the plurality of data lines corresponding to the scanning signal of the gate-on voltage. A switching transistor formed at each pixel is turned on according to the scanning signal of the gate-on voltage, and a data signal provided from the data driver is inputted to a pixel through the turned-on switching transistor so that an image is displayed.

The scan driver usually includes a plurality of scan driving circuits to sequentially output the scanning signals of the gate-on voltage, and each scan driving circuit includes a plurality of thin film transistors. A thin film transistor using amorphous silicon (a-Si) has a drawback that the thin film transistor is sensitive to temperature and has low mobility. As temperature is reduced, the mobility and the current amount of a thin film transistor using amorphous silicon are gradually reduced.

When ambient temperature falls down, the level of the scanning signal output from a scan driver including a thin film transistor using amorphous silicon may become lower than the reference value, and the transistor of a pixel may not normally switched, thereby resulting in a failure in driving the pixel.

The above information disclosed in this Background section is only for enhancement of understanding of the background of the invention, and therefore it may contain information that does not form the prior art that is already known to a person of ordinary skill in the art.

SUMMARY

Exemplary embodiments of the present disclosure have been made in an effort to provide a display device and a driving method thereof having advantages of compensating the level of the gate-on voltage for variations in ambient temperature.

According to an exemplary embodiment of the present disclosure, there is provided a display device, including: a plurality of pixels; a scan driver connected to a plurality of scanning lines connected to the plurality of pixels; and a gate signal generator configured to determine a level of a gate-on voltage according to ambient temperature and to supply the gate-on voltage to the scan driver, wherein the gate signal generator is further configured to apply a hysteresis characteristic to a thermistor voltage to vary according to the ambient temperature.

According to another exemplary embodiment of the present disclosure, there is provided a method of driving a display device, the method including: supplying a thermistor voltage to vary according to ambient temperature and a preset voltage; applying a hysteresis characteristic to the thermistor voltage; supplying a switch signal based on the thermistor voltage and the preset voltage; and determining a level of a gate-on voltage to supply to a scan driver connected to a plurality of scanning lines connected to a plurality of pixels according to the switch signal.

It is to be understood that both the foregoing general description and the following detailed description are exemplary and explanatory and are intended to provide further explanation of the invention as claimed.

DETAILED DESCRIPTION OF THE ILLUSTRATED EMBODIMENTS

Figure 1:
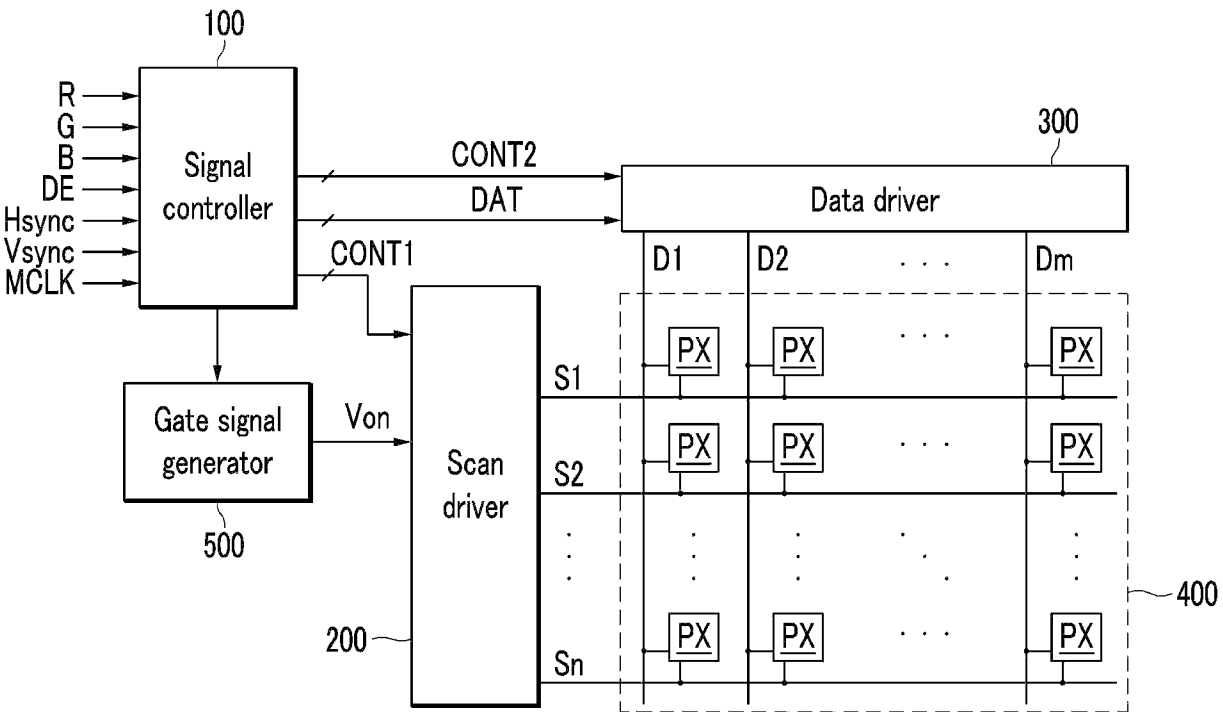
FIG. 1 is a block diagram illustrating a display device according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention.

Further, in various exemplary embodiments, the same constituent elements will be assigned the same reference numerals and will be described in only the first exemplary embodiment. Only constituent elements of another exemplary embodiment different from those of the first exemplary embodiment will be described.

Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. It will also be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ). In addition, unless explicitly described to the contrary, the word "comprise" and variations such as "comprises" or "comprising" will be understood to imply the inclusion of stated elements but not the exclusion of any other elements.

FIG. 1 is a block diagram illustrating a display device according to an exemplary embodiment of the present invention.

Referring to FIG. 1, the display device may include a signal controller 100, a scan driver 200, a data driver 300, a display unit 400, and a gate signal generator 500.

In accordance with one exemplary embodiment, the display unit 400 may include a plurality of pixels PX substantially arranged in a matrix pattern, a plurality of scanning lines S1 to Sn, and a plurality of data lines D1 to Dm. The display unit 400 may be, for example, an organic light emitting diode (OLED), a liquid crystal display (LCD) or any other types of display devices that use transistors. The plurality of pixels PX are connected to the plurality of scanning lines S1 to Sn and the plurality of data lines D1 to Dm. The plurality of scanning lines S1 to Sn may substantially extend in the row direction to be arranged in parallel, and the plurality of data lines D1 to Dm may substantially extend in the column direction to be arranged in parallel.

The signal controller 100 may receive image signals R, G, and B and a synchronization signal input from an external element. The image signals R, G, and B may include luminance information of the plurality of pixels. The luminance information may include a predetermined number of grays, for example, $1024=2^{10}$, $256=2^{8}$, or $64=2^{6}$. The synchronization signal may include a data enable signal DE, a horizontal synchronizing signal Hsync, a vertical synchronization signal Vsync, and a main clock signal MCLK.

The signal controller 100 may generate a first drive control signal CONT1, a second drive control signal CONT2, and image data DAT according to the image signals R, G, and B, the data enable signal DE, the horizontal synchronizing signal Hsync, the vertical synchronization signal Vsync, and the main clock signal MCLK. The signal controller 100 may generate the image data DAT by classifying the image signals R, G, and B in a frame unit according to the vertical synchronization signal Vsync, and classifying the image signals R, G, and B in a scanning line unit according to the horizontal synchronizing signal Hsync. The signal controller 100 may transfer the first drive control signal CONT1 to the scan driver 200. The signal controller 100 may also transfer image data DAT to the data driver 300 together with the second drive control signal CONT2.

The scan driver 200 may be connected to the plurality of scanning lines S1 to Sn to generate a plurality of scanning signals according to the first drive control signal CONT1. The scan driver 200 may sequentially apply scanning signals of the gate-on voltage to the plurality of scanning lines S1 to Sn.

In accordance with one exemplary embodiment, the data driver 300, which may be connected to the plurality of data lines D1 to Dm, may perform sampling and holding of input image data DAT according to a second drive control signal CONT2 and transfer a plurality of data signals to a plurality of data lines D1 to Dm. The data driver 300 may apply data signals in a predetermined voltage range to the plurality of data lines D1 to Dm corresponding to the scanning signals of the gate-on voltage.

Further, the gate signal generator 500 may determine the level of the gate-on voltage Von according to ambient temperature to transfer the gate-on voltage Von to the scan driver 200. A detailed description of the gate signal generator 500 will be given later.

The signal controller 100, the scan driver 200, the data driver 300, and the gate signal generator 500 may be directly mounted, for example, on the display unit 400 in the form of at least one IC chip, may be mounted on a flexible printed circuit film (FPC), may be attached on the display unit 400 in the form of a tape carrier package (TCP), or may be mounted on a separate printed circuit board (PCB). The signal controller 100, the scan driver 200, the data driver 300, and the gate signal generator 500 may be integrated with the display unit 400 and also with the plurality of scanning lines S1 to Sn and the plurality of data lines D1 to Dm.

Hereinafter, the gate signal generator 500 will be described.

Figure 2:
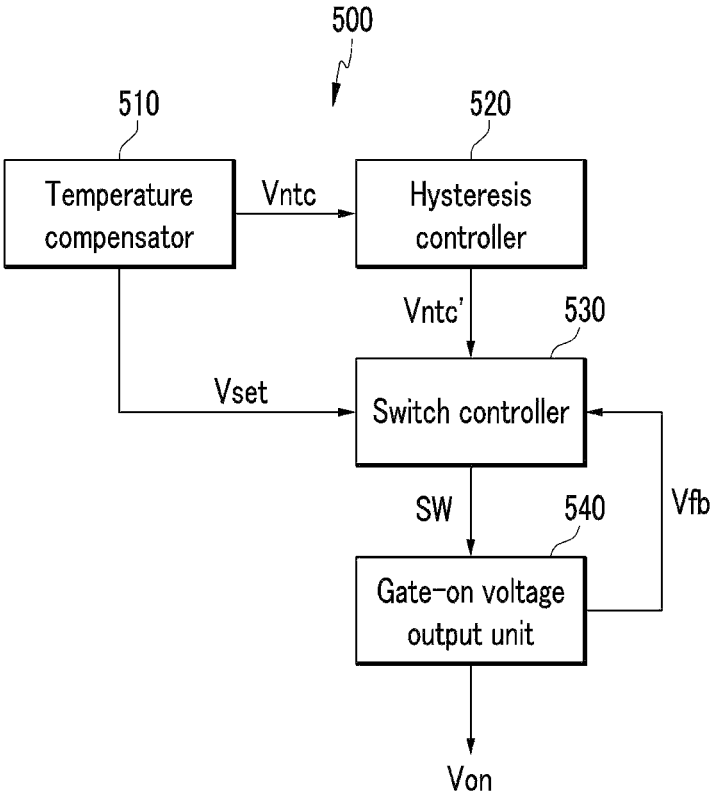
FIG. 2 is a block diagram illustrating a gate signal generator according to an exemplary embodiment of the present invention.

FIG. 2 is a block diagram illustrating a gate signal generator according to an exemplary embodiment of the present invention.

Referring to FIG. 2, the gate signal generator 500 may include a temperature compensator 510, a hysteresis controller 520, a switch controller 530, and a gate-on voltage output unit 540.

In accordance with one exemplary embodiment, the temperature compensator 510 may measure ambient temperature using a suitable device such as a thermistor. The temperature compensator 510 may then output a thermistor voltage Vntc and a preset voltage Vset according to the ambient temperature. The temperature compensator 510 may transfer the thermistor voltage Vntc to the hysteresis controller 520 and transfer the preset voltage Vset to the switch controller 530.

The hysteresis controller 520 may apply hysteresis properties to the hysteresis voltage Vntc. For example, the hysteresis controller 520 may output a hysteresis voltage Vntc' that is delayed by a hysteresis value. That is, the hysteresis controller 520 may delay the changes in the thermistor voltage Vntc by a predetermined hysteresis value (i.e., the thermistor voltage Vntc is maintained to be constant for a certain amount of time), especially, in two regions where the slope of the gate-on voltage Von according to changes in ambient temperature is relatively large. The hysteresis controller 520 may prevent the level of the gate-on voltage Von from varying according to the thermistor voltage Vntc by delaying any changes to the thermistor voltage Vntc in the two regions where the slope of the gate-on voltage Von is relatively large. As such, the hysteresis controller 520 may apply hysteresis consideration to the thermistor voltage Vntc and then transfer the hysteresis voltage Vntc' to the switch controller 530.

In accordance with one exemplary embodiment, the switch controller 530 may generate a switch signal SW based on the hysteresis voltage Vntc' and the preset voltage Vset. The switch signal SW may include a combination of a high level voltage and a low level voltage. As a characteristic of the switch signal SW, the duty ratio of the switch signal SW represents the ratio of the time when the high level voltage is applied to the time when the low level voltage is applied. The switch controller 530 may transfer the switch signal SW to the gate-on voltage output unit 540.

The gate-on voltage output unit 540 may receive the switch signal SW and output the gate-on voltage Von. The gate-on voltage output unit 540 may determine and output the level of the gate-on voltage Von according to the duty ratio of the switch signal SW. When outputting the gate-on voltage Von, the gate-on voltage output unit 540 may generate the feedback voltage Vfb and transfer the feedback voltage Vfb to the switch controller 530.

The switch controller 530 may control the level of the gate-on voltage Von output from the gate-on voltage output unit 540 based on the feedback voltage Vfb. To this end, the switch controller 530 may control the duty ratio of the switch signal SW so that the feedback voltage Vfb becomes a voltage depending on the conditions of the thermistor voltage Vntc and the preset voltage Vset.

Figure 3:
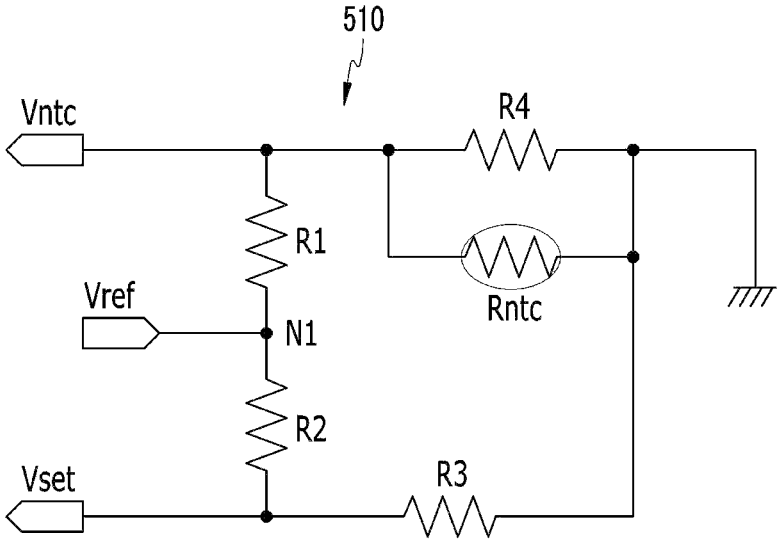
FIG. 3 is a circuit diagram illustrating a temperature compensator included in a gate signal generator according to an exemplary embodiment of the present invention.

FIG. 3 is a circuit diagram illustrating a temperature compensator included in a gate signal generator according to an exemplary embodiment of the present invention.

Referring to FIG. 3, the temperature compensator 510 includes a plurality of resistors R1 to R4 and a thermistor Rntc.

In accordance with one exemplary embodiment, the first resistor R1 may be connected between a first node N1 to which a reference voltage Vref is applied, and an output terminal of the thermistor voltage Vntc. The reference voltage Vref is a power supply voltage to generate the thermistor voltage Vntc and the preset voltage Vset, and may be provided from an external power supply device.

The second resistor R2 may be connected between the first node N1 and an output terminal of the preset voltage Vset. The third resistor R3 may be connected between the output terminal of the preset voltage Vset and ground. The level of the preset voltage Vset is determined based on the reference voltage Vref, the resistance of the second resistor R2, and the resistance of the third resistor R3. Equation 1 expresses the preset voltage Vset.

$$Vset = \frac{R2}{R2 + R3} \times Vref \quad \text{(Equation 1)}$$

If the reference voltage Vref, the resistance of the second resistor R2, and the resistance of the third resistor R3 are determined, the level of the preset voltage Vset is determined. For example, if the reference voltage Vref is 3.3 V, the resistance of the second resistor R2 is 12.0 kΩ, and the resistance of the third resistor R3 is 20.01 kΩ, the preset voltage Vset becomes 2.06 V.

A fourth resistor R4 may be connected between the output terminal of the thermistor voltage Vntc and ground. The thermistor Rntc may be connected between the output terminal of the thermistor voltage Vntc and ground. The thermistor Rntc is a device with resistance that varies as ambient temperature changes. The thermistor Rntc may include a static characteristic thermistor of which the resistance increases as the temperature increases, or a negative characteristic thermistor of which the resistance decreases as the temperature increases. In this case, it is assumed that the thermistor Rntc is a negative characteristic thermistor of which the resistance decreases as the temperature increases.

The fourth resistor R4 may be connected to the thermistor Rntc in parallel to form parallel resistance RT. The following Equation 2 represents the parallel resistance RT determined by the fourth resistor R4 and the thermistor Rntc.

$$RT = \frac{R4 \times Rntc}{R4 + Rntc} \quad \text{(Equation 2)}$$

The level of the thermistor voltage Vntc is determined based on the reference voltage Vref, the first resistance R1, and the parallel resistance RT. The following Equation 3 represents the thermistor voltage Vntc.

$$Vntc = \frac{RT}{R1 + RT} \times Vref \quad \text{(Equation 3)}$$

If the resistance of the thermistor Rntc is obtained based on the ambient temperature, the parallel resistance RT is determined. The thermistor voltage Vntc is determined based on the reference voltage Vref, the first resistance R1, and the parallel resistance RT. For example, if the resistance of the fourth resistor R4 is 2.4 kΩ and the thermistor Rntc has resistance of 22.0 kΩ at 5° C., the parallel resistance RT becomes 2.2 kΩ. In this case, if the reference voltage Vref is 3.3 V and the resistance of the first resistor R1 is 4.8 kΩ, the thermistor voltage Vntc becomes 1.03 V.

As described above, the temperature compensator 510 generates a thermistor voltage Vntc which varies according to a preset voltage Vset at a predetermined level and the ambient temperature.

Figure 4:
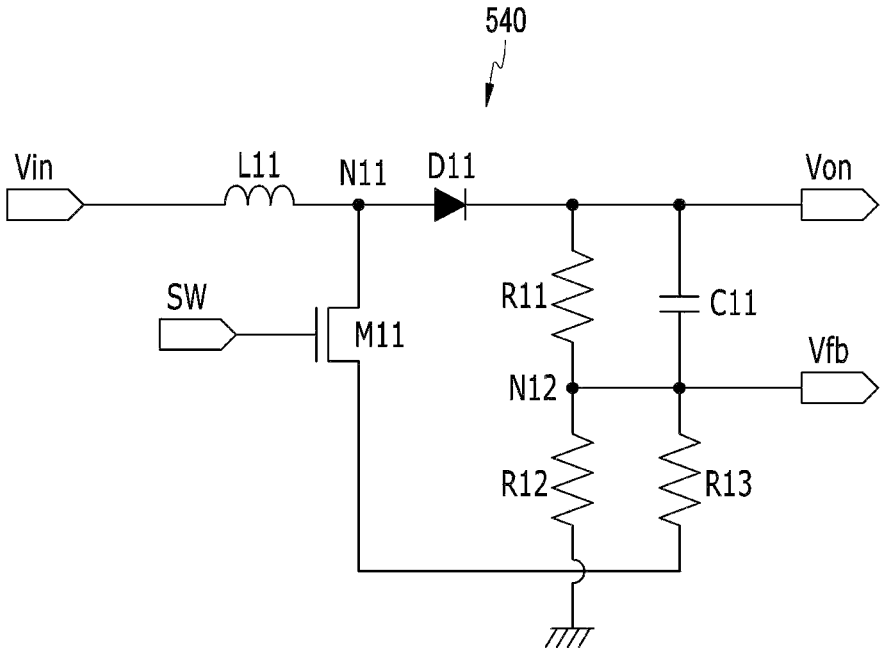
FIG. 4 is a circuit diagram illustrating a gate-on voltage output unit included in a gate signal generator according to an exemplary embodiment of the present invention.

FIG. 4 is a circuit diagram illustrating a gate-on voltage output unit included in a gate signal generator according to an exemplary embodiment of the present invention.

Referring to FIG. 4, the gate-on voltage output unit 540 may include an inductor L11, a diode D11, a switch M11, a plurality of resistors R11, R12, and R13, and a capacitor C11.

The inductor L11 may be connected between the input terminal of an input voltage Vin and a first node N11. The input voltage Vin may include a direct current (DC) voltage provided from an external power supply device. For example, the input voltage Vin may be a DC voltage of 12 V.

The diode D11 may be connected between the first node N11 and the output terminal of the gate-on voltage Von. The diode D11 may allow a current flow from the first node N11 to the output terminal of the gate-on voltage Von and prevent a current from flowing in the reverse direction.

The switch M11 may be connected between the first node N11 and the third resistor R13. The switch M11 may be a transistor. The switch M11, as a transistor, may include a gate electrode to which the switch signal SW is applied, one electrode connected to the first node N11, and another electrode connected to the third resistor R13. Although FIG. 4 shows that the switch M11 is an n-channel electric field effect transistor, the switch M11 may be a p-channel electric field effect transistor. When an n-channel electric field effect transistor is used for the switch M11, the switch signal SW may include a high level voltage to turn on the n-channel electric field effect transistor and a low level voltage to turn off the n-channel electric field effect transistor. On the other hand, when a p-channel electric field effect transistor is used for the switch M11, the switch signal SW may include a low level voltage to turn on the p-channel electric field effect transistor and a high level voltage to turn off the p-channel electric field effect transistor.

The first resistor R11 may be connected between the output terminal of the gate-on voltage Von and the second node N12, and the second resistor R12 may be connected between the second node N12 and ground. The second node N12 may be connected to the output terminal of the feedback voltage Vfb. The voltage corresponding to a difference between the gate-on voltage Von and the ground voltage is distributed through the first resistor R11 and the second resistor R12. Therefore, the voltage of the second node N12, which is a distribution voltage between the first resistor R11 and the second resistor R12, becomes the feedback voltage Vfb.

The capacitor C11 may be connected between the output terminal of the gate-on voltage Von and the second node N12.

The third resistor R13 may be connected between the switch M11 and the second node N12.

The switch M11 may be turned on/off according to the switch signal SW. If the switch M11 is turned off, the current amount flowing from the first node N11 to the output terminal of the gate-on voltage Von through the diode D11 is increased, and the voltage at the output terminal of the gate-on voltage Von is increased. If the switch M11 is turned on, the current amount flowing from the first node N11 to the output terminal of the gate-on voltage Von through the diode D11 is decreased, and the voltage at the output terminal of the gate-on voltage Von is decreased.

In this manner, the current amount flowing to the output terminal of the gate-on voltage Von is controlled by repeating on/off switching of the switch M11 so that the level of the gate-on voltage Von may be controlled. The level of the gate-on voltage Von is determined by the duty ratio of the switch signal SW.

Figure 5:
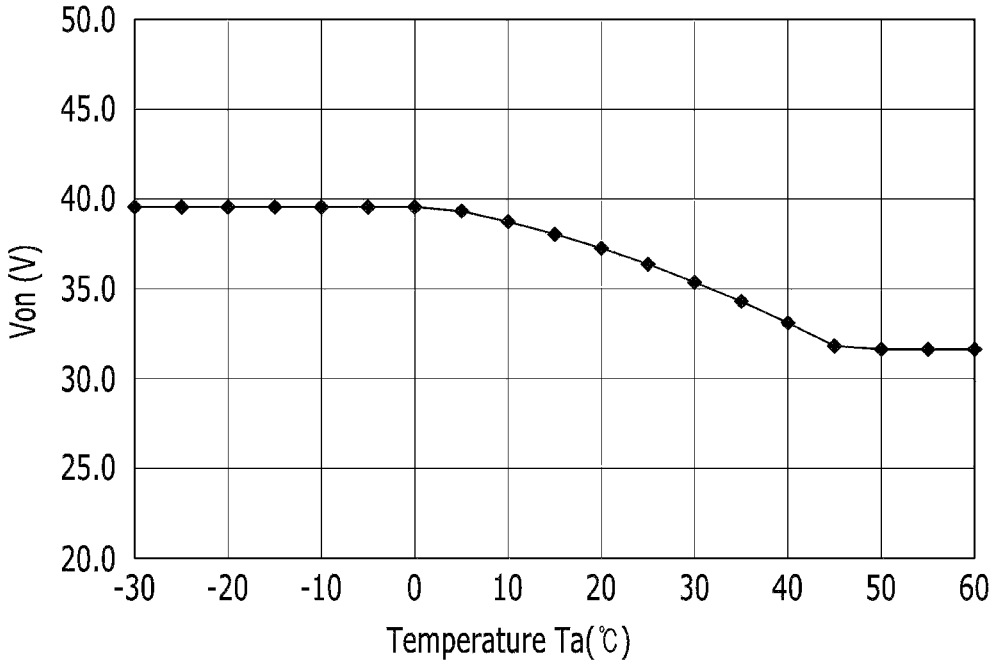
FIG. 5 is a graph illustrating exemplary changes of a gate-on voltage according to ambient temperature.
Figure 6:
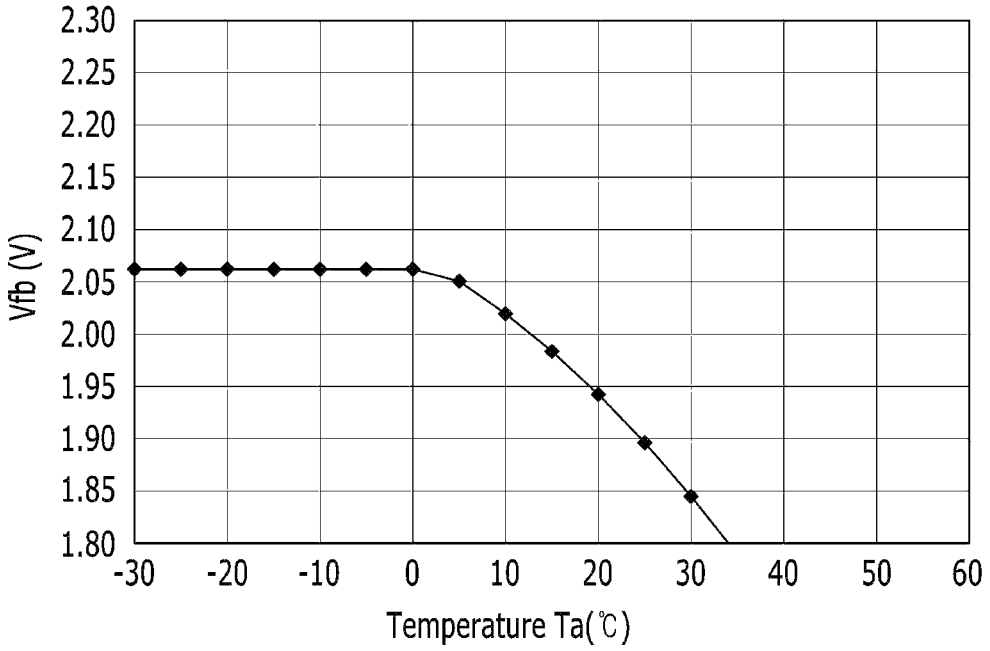
FIG. 6 is a graph illustrating exemplary changes of a feedback voltage according to ambient temperature.

Hereinafter, experimental examples of measuring characteristics of the gate-on voltage Von and the feedback voltage Vfb according to ambient temperature will be described with reference to FIGS. 5 and 6. FIG. 5 is a graph illustrating exemplary changes of the gate-on voltage according to ambient temperature. FIG. 6 is a graph illustrating exemplary changes of the feedback voltage according to ambient temperature.

In these experiments, the reference voltage Vref of the temperature compensator 510 was 3.3 V, the resistance of the first resistor R1 was 4.8 kΩ, the resistance of the second resistor R2 was 12.0 kΩ, and the resistance of the third resistor R3 was 20.0 kΩ. Further, the input voltage Vin of the gate-on voltage output unit 540 was 12 V, the resistance of the first resistor R11 was 40 kΩ, the resistance of the second resistor R12 was 470 kΩ, and the resistance of the third resistor R13 was 2.2 kΩ.

The resistance of the thermistor Rntc according to ambient temperature, the parallel resistance RT, the thermistor voltage Vntc, the gate-on voltage Von, and the feedback voltage Vfb are as listed in Table 1.

TABLE 1

| Ta(° C.) | Rntc(kΩ) | RT(kΩ) | Vntc(V) | Von(V) | Vfb(V) | 2 Vntc(V) |
|---|---|---|---|---|---|---|
| −40 | 195.7 | 2.4 | 1.09 | 39.6 | 2.06 | 2.18 |
| −35 | 148.2 | 2.4 | 1.09 | 39.6 | 2.06 | 2.18 |
| −30 | 113.3 | 2.4 | 1.08 | 39.6 | 2.06 | 2.17 |
| −25 | 87.6 | 2.3 | 1.08 | 39.6 | 2.06 | 2.16 |
| −20 | 68.2 | 2.3 | 1.07 | 39.6 | 2.06 | 2.15 |
| −15 | 53.7 | 2.3 | 1.07 | 39.6 | 2.06 | 2.14 |
| −10 | 42.5 | 2.3 | 1.06 | 39.6 | 2.06 | 2.12 |
| −5 | 33.9 | 2.2 | 1.05 | 39.6 | 2.06 | 2.10 |
| 0 | 27.2 | 2.2 | 1.04 | 39.6 | 2.06 | 2.08 |
| 5 | 22.0 | 2.2 | 1.03 | 39.3 | 2.05 | 2.05 |
| 10 | 17.9 | 2.1 | 1.01 | 38.7 | 2.02 | 2.02 |
| 15 | 14.7 | 2.1 | 0.99 | 38.1 | 1.98 | 1.98 |
| 20 | 12.1 | 2.0 | 0.97 | 37.3 | 1.94 | 1.94 |
| 25 | 10.0 | 1.9 | 0.95 | 36.4 | 1.90 | 1.90 |
| 30 | 8.3 | 1.9 | 0.92 | 35.4 | 1.84 | 1.84 |
| 35 | 6.9 | 1.8 | 0.89 | 34.3 | 1.79 | 1.79 |
| 40 | 5.8 | 1.7 | 0.86 | 33.1 | 1.73 | 1.73 |
| 45 | 4.9 | 1.6 | 0.83 | 31.8 | 1.66 | 1.66 |
| 50 | 4.2 | 1.5 | 0.79 | 31.7 | 1.65 | 1.59 |
| 55 | 3.5 | 1.4 | 0.76 | 31.7 | 1.65 | 1.51 |
| 60 | 3.0 | 1.3 | 0.72 | 31.7 | 1.65 | 1.44 |

The characteristics of the gate-on voltage Von depending on ambient temperature Ta can be described as follows. When the temperature Ta is equal to or greater than 50° C., the gate-on voltage Von is constant at 31.7 V. When the ambient temperature Ta is in a range of 45° C. to 5° C., the gate-on voltage Von is increased as the ambient temperature Ta is reduced. When the ambient temperature Ta is less than or equal to 0° C., the gate-on voltage Von may be constant at 39.6 V.

It is noted that the feedback voltage Vfb according to the ambient temperature Ta demonstrates a similar tendency to the gate-on voltage Von in the same ranges of the ambient temperature Ta. The characteristic of the feedback voltage Vfb may be expressed as in the following Table 2.

TABLE 2

| Classification | Condition | Feedback voltage (Vfb) |
|---|---|---|
| 1 | 2Vntc > Vset | Vset |
| 2 | Vset > 2Vntc > 1.65 V | 2Vntc |
| 3 | 1.65 V > 2Vntc | 1.65 V |

If the preset voltage Vset is calculated using Equation 1, the preset voltage Vset becomes 2.06 V.

When the voltage 2Vntc, which is twice the thermistor voltage Vntc, is greater than the preset voltage Vset, the feedback voltage Vfb may be the same as the preset voltage Vset. This corresponds to a range where the ambient temperature Ta is less than or equal to 0° C.

When the voltage 2Vntc, which is twice that of the thermistor voltage Vntc, is less than the preset voltage Vset and greater than 1.65 V, the feedback voltage Vfb is the same as the voltage 2Vntc. The voltage of 1.65 V corresponds to the minimum value of the feedback voltage Vfb, which can be observed when the ambient temperature Ta is in the range of 5° C. to 45° C.

When the voltage 2Vntc, which is twice that of the thermistor voltage Vntc, is less than 1.65 V, the feedback voltage Vfb becomes 1.65 V which corresponds to the minimum value of the feedback voltage Vfb. This can be observed in a range where the ambient temperature Ta is equal to or greater than 50° C.

In the above experiments, since the resistance of the thermistor Rntc, the parallel resistance RT, the thermistor voltage Vntc, the gate-on voltage Von, and the feedback voltage Vfb were measured with respect to ambient temperature Ta in increments of 5° C., the results for the feedback voltage Vfb were also observed accordingly in increments of 5° C. If the resistance of the thermistor Rntc, the parallel resistance RT, the thermistor voltage Vntc, the gate-on voltage Von, and the feedback voltage Vfb are measured in smaller increments with respect to the ambient temperature Ta, the results for the feedback voltage Vfb can be observed in smaller increments.

The switch controller 530 may receive the preset voltage Vset from the temperature compensator 510, receive the hysteresis voltage Vntc' from the hysteresis controller 520, determine which of Conditions 1 to 3 as presented in Table 2 applies, and generate the switch signal SW to generate a feedback voltage Vfb corresponding to the determined condition. That is, when the voltage 2Vntc is greater than the preset voltage Vset, the switch controller 530 may controls the duty ratio of the switch signal SW so that the feedback voltage Vfb is the same as the preset voltage Vset. When the voltage 2Vntc is less than the preset voltage Vset and greater than the minimum value of the feedback voltage Vfb, the switch controller 530 may control the duty ratio of the switch signal SW so that the feedback voltage Vfb is the same as the voltage 2Vntc.

When the voltage 2Vntc is less than the minimum value of the feedback voltage Vfb, the switch controller 530 may control the duty ratio of the switch signal SW so that the feedback voltage Vfb is the same as the minimum value of the feedback voltage Vfb.

Because the feedback voltage Vfb is correlated with the gate-on voltage Von, if the feedback voltage Vfb is generated depending on the ambient temperature Ta, the gate-on voltage Von may be generated depending on the ambient temperature Ta.

When the thermistor voltage Vntc is in Condition 1, the feedback voltage Vfb is determined to be the preset voltage Vset, which may be, for example, 2.06 V. When the thermistor voltage Vntc is in Condition 2, the feedback voltage Vfb is determined as the voltage 2Vntc that is twice that of the thermistor voltage Vntc. When the thermistor voltage Vntc in Condition 3, the feedback voltage Vfb is determined to be 1.65 V which is the minimum value for the feedback voltage Vfb. When the thermistor voltage Vntc hovers around the boundaries between Condition 1 and Condition 2 or between Condition 2 and Condition 3, the output value of the gate-on voltage Von may vary widely even if the thermistor voltage Vntc slightly changes. The boundary region between Condition 1 and Condition 2 and the boundary region between Condition 2 and Condition 3 correspond to two regions where the slope change of the gate-on voltage Von is relatively large.

If a ripple or a noise occurs in the thermistor voltage Vntc due to couplings with wires disposed around the gate signal generator 500, the level of the gate-on voltage Von may unstably fluctuate. Even if the thermistor voltage Vntc fluctuates by 0.02 V to 0.05 V, the level of the gate-on voltage Von may also fluctuate as a result. That is, the variation in the gate-on voltage Von of the above extent may occur due to the ripple or the noise of the thermistor voltage Vntc.

The fluctuation of the thermistor voltage Vntc, especially around the boundaries where the feedback voltage Vfb changes, may cause instability in the gate-on voltage Von. For ease of description, a transition where the thermistor voltage Vntc is switched from Condition 3 to Condition 2 is referred to as a temperature compensation trigger procedure, and a transition where the thermistor voltage Vntc is switched from Condition 2 to Condition 3 is referred to as a temperature compensation release procedure. If a ripple or a noise occurs in the thermistor voltage Vntc when the thermistor voltage Vntc is located at the boundary between Condition 2 and Condition 3, the temperature compensation trigger procedure and the temperature compensation release procedure may be repeated.

If the temperature compensation trigger procedure and the temperature compensation release procedure are repeated, and the level of the gate-on voltage Von continuously varies, the gate-on voltage Von may not be stably outputted, and the gate signal generator 500 may erroneously be operated.

The hysteresis controller 520 of the gate signal generator 500 may solve this problem by introducing a hysteresis characteristic to the thermistor voltage Vntc in the boundary regions between Condition 1 and Condition 2 and/or between Condition 2 and Condition 3.

Figure 7:
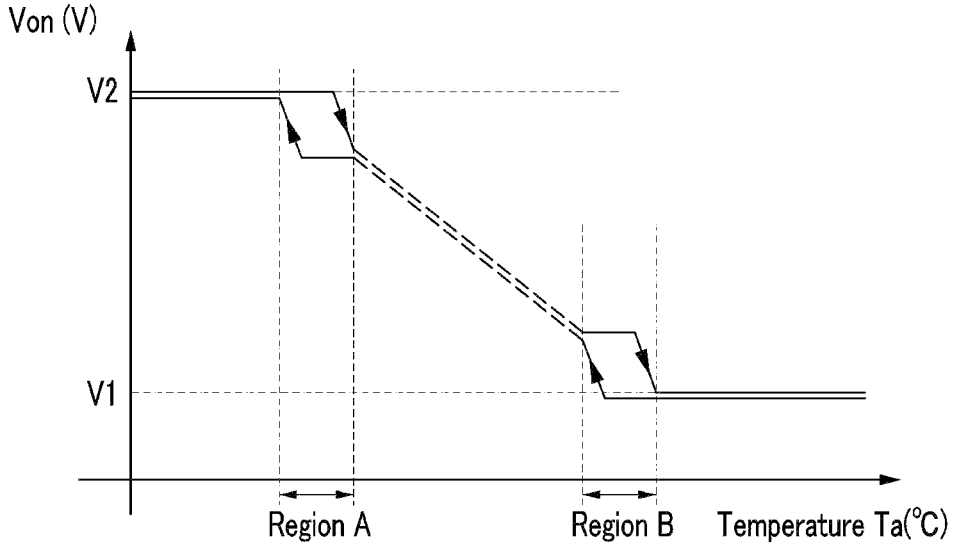
FIG. 7 is a graph illustrating a method of outputting a gate-on voltage by applying a hysteresis characteristic to a thermistor voltage by a gate signal generator according to an exemplary embodiment of the present invention.

FIG. 7 is a graph illustrating a method of outputting a gate-on voltage by applying a hysteresis characteristic to a thermistor voltage by a gate signal generator according to an exemplary embodiment of the present invention.

Referring to FIG. 7, when the gate-on voltage Von is reduced in a first region where the slope change of the gate-on voltage Von is relatively large according to the increase in the ambient temperature Ta (e.g., Region A), the gate-on voltage Von is intentionally maintained to be constant for a predetermined hysteresis value before it is reduced. In other words, the reduction of the gate-on voltage Von may intentionally be delayed for a certain amount of time determined by hysteresis consideration. Further, when the gate-on voltage Von is increased according to a reduction in the temperature, the gate-on voltage Von is maintained for a predetermined hysteresis value before it is increased. In other words, the increase of the gate-on voltage Von may intentionally be delayed for a certain amount of time determined by hysteresis consideration. This may be achieved by applying a hysteresis characteristic to the thermistor voltage Vntc when the thermistor voltage Vntc is located in the boundary regions between Condition 1 and Condition 2 (i.e., Region A).

When the gate-on voltage Von is reduced in a second region where the slope change of the gate-on voltage Von is relatively great according to an increase in the ambient temperature Ta (e.g., Region B), the gate-on voltage Von is maintained to be constant for a predetermined hysteresis value before it is reduced. Further, when the gate-on voltage Von is increased according to a reduction in the temperature, the gate-on voltage Von is maintained to be constant for a predetermined hysteresis value before it is increased. That is, the change in the gate-on voltage Von may be delayed for a curtained amount time determined by hysteresis consideration in Region B. This may be achieved by applying a hysteresis characteristic to the thermistor voltage Vntc when the thermistor voltage Vntc is located in the boundary region between Condition 2 and Condition 3 (i.e., Region B).

The range of the first region and the range of the second region may be determined appropriately depending on the types of the devices. For example, the range of the first and second regions may be determined as 3° C. ambient temperature. In this case, the hysteresis voltage Vntc' may be, for example, about 0.05 V (50 mV).

The hysteresis controller 520 to apply the hysteresis characteristic may include a Schmitt trigger circuit.

By introducing hysteresis characteristics to the thermistor voltage Vntc in the first region and the second region where the slope change of the gate-on voltage Von is relatively large, the temperature compensation trigger procedure and the temperature compensation release procedure may be prevented from being switched from each other repeatedly, and the level of the gate-on voltage Von may be prevented from being changed undesirably often.

The detailed description of the accompanying drawings and the invention only relate to an embodiment of the present invention, and are used for the purpose of describing the present invention but are not used to limit the meanings or a range of the present invention described in the claims. Accordingly, those skilled in the art to which the invention pertains can easily understand that various modifications and equivalent embodiments may be possible. Therefore, a substantial technical protective range of the present invention will be determined based on a technical idea of the appended claims.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device, comprising:

a plurality of pixels;

a scan driver connected to a plurality of scanning lines connected to the plurality of pixels; and a gate signal generator configured to determine a level of a gate-on voltage according to ambient temperature and to supply the gate-on voltage to the scan driver, wherein the gate signal generator is further configured to apply a hysteresis characteristic to a thermistor voltage, the thermistor voltage varying according to the ambient temperature, and wherein the gate signal generator comprises a gate-on voltage output unit configured to determine the level of the gate-on voltage according to a duty ratio of a switch signal.

2. The display device of claim 1, wherein the gate signal generator further comprises:

a temperature compensator configured to output the thermistor voltage according to the ambient temperature and a preset voltage;

a hysteresis controller configured to apply the hysteresis characteristic to the thermistor voltage;

a switch controller configured to generate the switch signal based on the thermistor voltage and the preset voltage.

3. The display device of claim 2, wherein the gate-on voltage output unit is further configured to generate a feedback voltage and to supply the generated feedback voltage to the switch controller, and the switch controller is further configured to control the duty ratio of the switch signal so that the feedback voltage comprises a voltage determined based on characteristics of the thermistor voltage and the preset voltage.

4. The display device of claim 3, wherein the temperature compensator comprises:

a first resistor connected between a first node to which a reference voltage is applied and a first terminal configured to output the thermistor voltage;

a second resistor connected between the first node and a second terminal configured to output the preset voltage;

a third resistor connected between the second terminal and a ground;

a fourth resistor connected between the first terminal and the ground; and a thermistor connected between the first terminal and the ground.

5. The display device of claim 4, wherein the temperature compensator is configured to determine a level of the preset voltage according to the reference voltage, resistance of the second resistor, and resistance of the third resistor.

6. The display device of claim 4, wherein the temperature compensator is configured to determine a level of the thermistor voltage based on the reference voltage, resistance of the first resistor, and parallel resistance of the thermistor and the fourth resistor.

7. The display device of claim 3, wherein the gate-on voltage output unit comprises:

an inductor connected between an input voltage terminal and a first node;

a diode connected between the first node and a gate-on voltage output terminal; and a switch comprising a gate electrode configured to receive the switch signal and a first electrode connected to the first node.

8. The display device of claim 7, wherein the gate-on voltage output unit further comprises:

a first resistor connected between the gate-on voltage output terminal and a second node;

a second resistor connected between the second node and the ground;

a capacitor connected between the gate-on voltage output terminal and the second node; and a third resistor connected between a second electrode of the switch and the second node, wherein the second node is connected to a feedback voltage output terminal.

9. The display device of claim 3, wherein the switch controller is further configured to control the duty ratio of the switch signal so that the feedback voltage is substantially equal to the preset voltage in response to determining that a condition voltage, which is twice the thermistor voltage, is greater than the preset voltage.

10. The display device of claim 9, wherein the switch controller is further configured to control the duty ratio of the switch signal so that the feedback voltage is substantially equal to twice the thermistor voltage in response to determining that the condition voltage is less than the preset voltage and greater than a minimum value of the feedback voltage.

11. The display device of claim 10, wherein the switch controller is configured to control the duty ratio of the switch signal so that the feedback voltage is equal to the minimum value of the feedback voltage in response to determining that the condition voltage is less than the minimum value of the feedback voltage.

12. The display device of claim 3, wherein the hysteresis controller is further configured to maintain the gate-on voltage for a first hysteresis value before reducing in response to detecting that the gate-on voltage is reduced into a first region where a slope of the gate-on voltage with respect to the ambient temperature is in a first range, and configured to maintain the gate-on voltage for the first hysteresis value before increasing in response to detecting that the gate-on voltage is increased according to a reduction in the temperature.

13. The display device of claim 12, wherein the hysteresis controller is configured to maintain the gate-on voltage for a second hysteresis value in response to detecting that the gate-on voltage is reduced into a second region where the slope of the gate-on voltage with respect to the ambient temperature is in a second range, and configured to maintain the gate-on voltage for the second hysteresis value in response to detecting that the gate-on voltage is increased according to a reduction in the ambient temperature.

14. A method of driving a display device, the method comprising:

supplying a thermistor voltage that varies according to ambient temperature and a preset voltage;

applying a hysteresis characteristic to the thermistor voltage;

supplying a switch signal based on the thermistor voltage and the preset voltage; and determining a level of a gate-on voltage to supply to a scan driver connected to a plurality of scanning lines connected to a plurality of pixels according to the switch signal, wherein determining the level of the gate-on voltage comprises determining the level of the gate-on voltage based on a duty ratio of the switch signal.

15. The method of claim 14, further comprising supplying a feedback voltage based on the gate-on voltage.

16. The method of claim 15, further comprising controlling the duty ratio of the switch signal so that the feedback voltage comprises a voltage determined based on conditions of the thermistor voltage and the preset voltage.

17. The method of claim 16, wherein the duty ratio of the switch signal is controlled so that the feedback voltage is equal to the preset voltage in response to determining that a condition voltage, which is twice the thermistor voltage, is greater than the preset voltage.

18. The method of claim 16, wherein the duty ratio of the switch signal is controlled so that the feedback voltage is equal to the condition voltage in response to determining that the condition voltage is less than the preset voltage and greater than a minimum value of the feedback voltage.

19. The method of claim 16, wherein the duty ratio of the switch signal is controlled so that the feedback voltage is equal to a minimum value of the feedback voltage in response to determining that the condition voltage is less than the minimum value of the feedback voltage.

20. A display device, comprising:

a plurality of pixels;

a scan driver connected to a plurality of scanning lines connected to the plurality of pixels; and a gate signal generator comprising a temperature compensator comprising:

a first resistor connected between a first node to which a reference voltage is applied and a first terminal configured to output a thermistor voltage;

a second resistor connected between the first node and a second terminal configured to output a preset voltage;

a third resistor connected between the second terminal and a ground;

a fourth resistor connected between the first terminal and the ground; and a thermistor connected between the first terminal and the ground, wherein the gate signal generator is configured to:

determine a level of a gate-on voltage according to ambient temperature, supply the gate-on voltage to the scan driver, and apply a hysteresis characteristic to the thermistor voltage so that the thermistor voltage varies according to the ambient temperature.

* * * * *